US009528202B2

(12) United States Patent
Chiu

(10) Patent No.: US 9,528,202 B2
(45) Date of Patent: Dec. 27, 2016

(54) DAISY CHAIN

(71) Applicant: Polyunion Textile (Shenzhen) Factory, Shenzhen (CN)

(72) Inventor: Chung Che Chiu, Shenzhen (CN)

(73) Assignee: POLYUNION TEXTILE (SHENZHEN) FACTORY, Shenzhen (CN)

( * ) Notice: Subject to any disclaimer, the term of this patent is extended or adjusted under 35 U.S.C. 154(b) by 0 days.

(21) Appl. No.: 14/591,160

(22) Filed: Jan. 7, 2015

(65) Prior Publication Data

US 2016/0177479 A1 Jun. 23, 2016

(30) Foreign Application Priority Data

Dec. 17, 2014 (CN) ..... 2014 2 0794512 U

(51) Int. Cl.

| | |
|---|---|
| ***D03D 11/02*** | (2006.01) |
| ***D03D 1/00*** | (2006.01) |
| ***D03D 15/04*** | (2006.01) |
| ***D03D 3/00*** | (2006.01) |
| ***A41F 9/00*** | (2006.01) |
| ***A63B 29/02*** | (2006.01) |

(52) U.S. Cl.

CPC ..... *D03D 11/02* (2013.01); *A41F 9/007* (2013.01); *A63B 29/02* (2013.01); *D03D 1/0005* (2013.01); *D03D 3/005* (2013.01); *D03D 15/04* (2013.01); *D10B 2331/04* (2013.01); *D10B 2403/0311* (2013.01); *D10B 2507/00* (2013.01)

(58) Field of Classification Search

CPC ..... D03D 11/02; D03D 3/005; D03D 25/005; D03D 3/00; D03D 11/00; D03D 15/12; D10B 2403/0311; D10B 2507/00; D10B 2331/04; D10B 2331/021; B32B 2307/736

USPC ..... 428/166, 178, 198

See application file for complete search history.

(56) References Cited

U.S. PATENT DOCUMENTS

2006/0068176 A1* 3/2006 Zafiroglu ..... B32B 7/04 428/198

FOREIGN PATENT DOCUMENTS

DE 202013103174 U1 * 8/2013 ..... D03D 1/007

OTHER PUBLICATIONS

Translation of DE 202013103174.*

* cited by examiner

*Primary Examiner* — Catherine A Simone
(74) *Attorney, Agent, or Firm* — Wayne & King LLC

(57) ABSTRACT

The present utility model discloses a daisy chain, comprising a first webbing and a second webbing, which are different in thermal shrinkage; the first webbing and the second webbing are seamless jointed together at two ends thereof, respectively; one-piece webbing units are woven relative to one another on opposite sides of the first webbing and the second webbing, the one-piece webbing units being uniformly distributed along the daisy chain at intervals; furthermore, a loop is further provided between the adjacent one-piece webbing units. The arrangement of one-piece webbing units avoids the safety hazards caused by the separation of the first webbing from the second webbing when the loop is long-term stressed. The daisy chain provided by the present utility model is simple in structure, and safe and reliable in use.

5 Claims, 1 Drawing Sheet

DAISY CHAIN

CROSS-REFERENCE TO RELATED APPLICATIONS

This application claims the benefit of Chinese application number 201420794512.5 filed Dec. 17, 2014. The contents of 201420794513.X are hereby incorporated by reference in it entirety.

TECHNICAL FIELD

The present utility model relates to the technical field of climbing, in particular to a daisy chain.

BACKGROUND OF THE PRESENT UTILITY MODEL

An existing daisy chain includes two webbings of same material, with a number of one-piece webbing units sewn by a needle swing machine at intervals and loops being provided between the adjacent one-piece webbing units. However, for a daisy chain made in such a manner, the one-piece webbing units sewn at the hoops are very prone to get torn during long-term use, causing great safety hazards.

SUMMARY OF THE PRESENT UTILITY MODEL

An objective of the utility model is to provide a strengthened daisy chain that is simple in structure and both safe and reliable.

To realize this purpose, the present utility model employs the following technical solutions.

A daisy chain is provided, including a first webbing and a second webbing, which are different in thermal shrinkage; the first webbing and the second webbing are seamless jointed together at two ends thereof, respectively; one-piece webbing units are woven relative to one another on opposite sides of the first webbing and the second webbing, the one-piece webbing units being uniformly distributed along the daisy chain at intervals; furthermore, a loop is further provided between the adjacent one-piece webbing units.

One side of the loop, after thermally processed, is shaped like an arc.

Each of the one-piece webbing units has a thickness equal to the sum of the thickness of the first webbing and the thickness of the second webbing.

Each of the one-piece webbing units has a length less than the maximum internal diameter of the loop.

Both the first webbing and the second webbing are high-strength polyester webbings of a monolayer structure.

The daisy chain is integrally woven by a loom.

The present utility model has the following beneficial effects. The daisy chain provided by the present utility model includes a first webbing and a second webbing, which are different in thermal shrinkage; the first webbing and the second webbing are seamless jointed together at two ends thereof, respectively; one-piece webbing units are woven relative to one another on opposite sides of the first webbing and the second webbing, the one-piece webbing units being uniformly distributed along the daisy chain at intervals; furthermore, a loop is further provided between the adjacent one-piece webbing units. The arrangement of one-piece webbing units avoids the safety hazards caused by the separation of the first webbing from the second webbing when the loop is long-term stressed. The daisy chain provided by the present utility model is simple in structure, and safe and reliable in use.

1-First webbing; 2-Second webbing; 3-One-piece webbing unit; 4-Hoop

DETAILED DESCRIPTION OF THE PRESENT UTILITY MODEL

The technical solutions of the present utility model will be further described with reference to the accompanying drawings by specific implementations.

Figure 1:
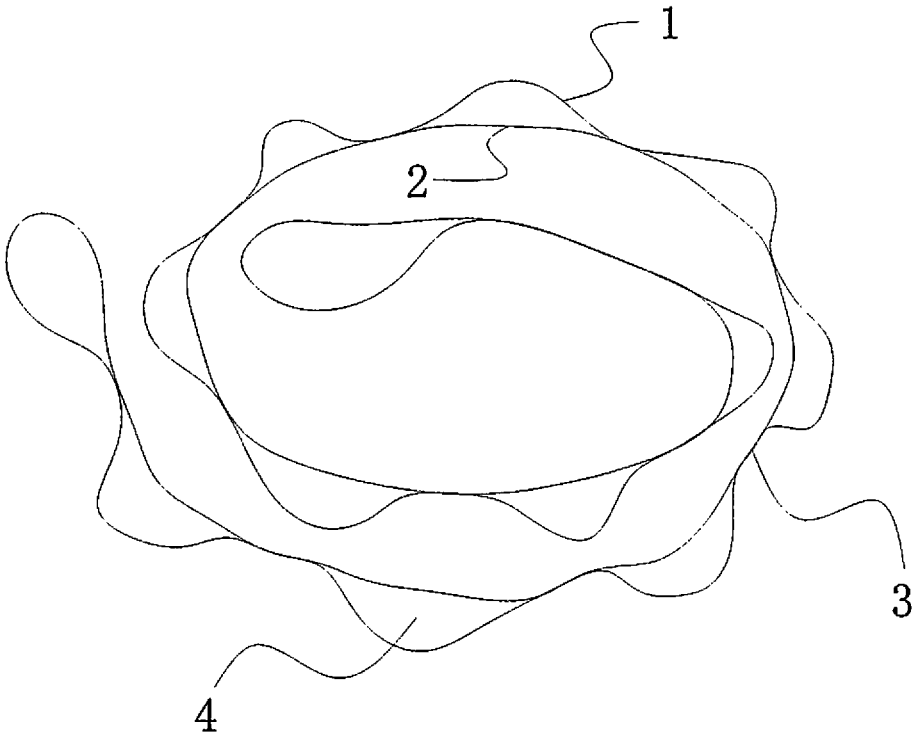
FIG. 1 is an axial diagram of a novel daisy chain according to the present utility model.
Figure 2:
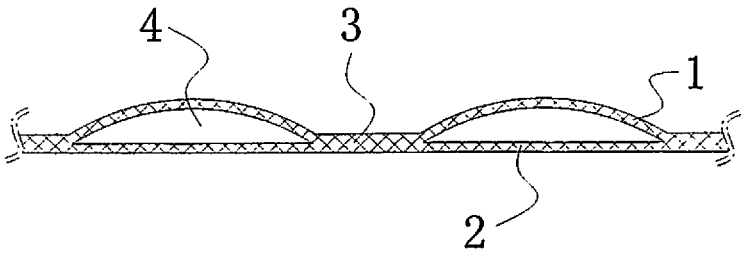
FIG. 2 is a structural diagram of an axial cross-section of the daisy chain according to the present utility model, in the drawings.

As shown in FIG. 1 and FIG. 2, a daisy chain is provided, including a first webbing 1 and a second webbing 2, which are different in thermal shrinkage; the first webbing 1 and the second webbing 2 are seamless jointed together at two ends thereof, respectively; one-piece webbing units 3 are woven relative to one another on opposite sides of the first webbing 1 and the second webbing 2, the one-piece webbing units 3 being uniformly distributed along the daisy chain at intervals; furthermore, a loop 4 is further provided between the adjacent one-piece webbing units 3. As a preferred implementation of the present utility model, the daisy chain in this embodiment is integrally woven by a loom of a first webbing 1 and a second webbing 2, which are different in thermal shrinkage. During weaving, a number of one-piece webbing units 3, which are distributed at intervals, are woven relative to one another on opposite sides of the first webbing 1 and the second webbing 2, and a loop 4 is further provided between the adjacent one-piece webbing units 3. In this embodiment, for a daisy chain having a length of 1.2 m, there are total 13 loops.

Due to the different thermal shrinkage of the first webbing 1 and the second webbing 2, one side of the loop, after thermally processed, is shaped like an arc, facilitating the hanging of external pendants and thus preventing the two opposite side walls of the loop 4 from clinging to each other.

As a preferred implementation, for ease of processing, both the first webbing 1 and the second webbing 2 are preferably high-strength polyester webbings of a monolayer structure; furthermore, each of the one-piece webbing units 3 has a thickness equal to the sum of the thickness of the first webbing 1 and the thickness of the second webbing 2, and each of the one-piece webbing units 3 has a length less than the maximum internal diameter of the loop 4.

Although the technical principle of the present utility model has been described above by specific embodiments, these descriptions are merely provided to explain the principle of the present utility model and shall be not constructed in any way as limiting the protection scope of the present utility model. Based on the explanations herein, a person of ordinary skill in the art may come up with other specific implementations of the present utility model without any creative efforts, and such implementations shall fall into the protection scope of the present utility model.

The invention claimed is:

1. A daisy chain, comprising a first webbing (1) and a second webbing (2), which are different in thermal shrinkage; the first webbing (1) and the second webbing (2) are seamless jointed together at two ends thereof, respectively; one-piece webbing units (3) are woven relative to one another on opposite sides of the first webbing (1) and the second webbing (2), the one-piece webbing units (3) being uniformly distributed along the daisy chain at intervals; furthermore, a loop (4) is further provided between the adjacent one-piece webbing units (3); wherein each of the one-piece webbing units (3) has a thickness equal to a sum of a thickness of the first webbing (1) and a thickness of the second webbing (2).

2. The daisy chain according to claim 1, wherein one side of the loop (4), after thermally processed, is shaped like an arc.

3. The daisy chain according to claim 1, wherein each of the one-piece webbing units (3) has a length less than the maximum internal diameter of the loop (4).

4. The daisy chain according to claim 1, wherein both the first webbing (1) and the second webbing (2) are high-strength polyester webbings of a monolayer structure.

5. The daisy chain according to claim 1, wherein the daisy chain is integrally woven by a loom.

* * * * *